United States Patent [19]

Gussack

[11] 4,006,067

[45] Feb. 1, 1977

[54] OXIDATION-REDUCTION PROCESS

[76] Inventor: Mark C. Gussack, 1 Overlook Ave., Great Neck, N.Y. 11021

[22] Filed: Mar. 5, 1973

[21] Appl. No.: 338,343

[52] U.S. Cl. ..... 204/151; 204/130; 204/149

[51] Int. Cl.[2] ..... C25C 1/10

[58] Field of Search ..... 204/149, 153, 51, 296, 204/151, 180 P, 283, 130, 89, 59

[56] References Cited

UNITED STATES PATENTS

| | | | |
|---|---|---|---|
| 2,228,264 | 1/1941 | Freedley | 204/283 X |
| 2,987,463 | 6/1961 | Baker et al. | 204/283 X |
| 3,168,458 | 2/1965 | Sprague | 204/283 X |
| 3,282,875 | 11/1966 | Connolly et al. | 204/296 X |
| 3,450,623 | 6/1969 | Joo et al. | 204/296 X |
| 3,481,851 | 12/1969 | Lancy | 204/180 P |
| 3,616,304 | 10/1971 | Bedi et al. | 204/51 |
| 3,650,925 | 3/1972 | Carlson | 204/153 |
| 3,655,535 | 4/1972 | Ruehlen et al. | 204/59 |
| 3,682,796 | 8/1972 | Bedi et al. | 204/89 X |

*Primary Examiner*—John H. Mack
*Assistant Examiner*—A. C. Prescott
*Attorney, Agent, or Firm*—Robert L. Goldberg

[57] ABSTRACT

The instant invention relates to a process for changing the oxidation state of a compound or ionic species preferably a dissolved ionic species, and the novel electrochemical cell utilized therein. In the instant process, the compound or ionic species is passed through a porous electrode, which is maintained at a voltage sufficient to change the oxidation state of said compound or ionic species. This process is especially useful for oxidation-reduction processes, wherein said species is an ion having the same charge as the porous electrode. The porous electrode is isolated from the oppositely charged electrode by a semipermeable membrane, said membrane being impermeable to said dissolved species. In a much preferred embodiment, the dissolved species is chromium in the +3 oxidation state, e.g., the chromium available in chromic acid solutions which have been "used" in plastic etching processes or in processes for the oxidation of organic compounds; and the membrane is fluoro sulfonic acid membrane. In this embodiment the "used" chromic acid solutions may be substantially regenerated and cycled for reuse in the above-mentioned processes. The porous anode preferably used in the regeneration of chromic acid solutions comprises a lead alloy or compound.

5 Claims, 1 Drawing Figure

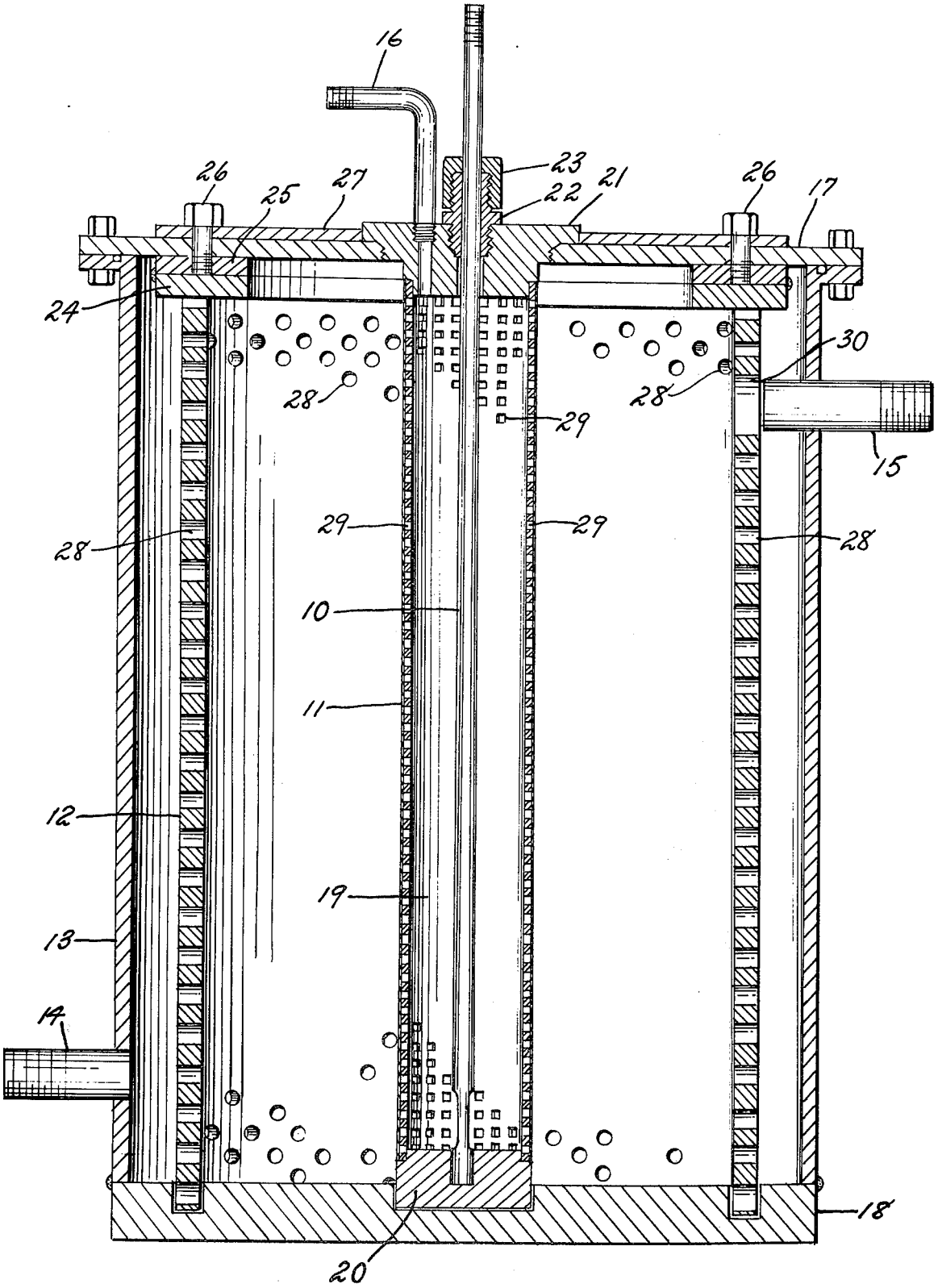
16
23
22
21
26
25
27
26
17
24
30
28
28
29
15
29
29
28
28
10
11
12
19
13
14
18
20

OXIDATION-REDUCTION PROCESS

FIELD OF THE INVENTION

The instant invention relates to a process for changing the oxidation state of a compound or ionic species preferably a dissolved ionic species, and the novel electrochemical cell utilized therein. In the instant process, the compound or ionic species is passed through a porous electrode, which is maintained at a voltage sufficient to change the oxidation state of said compound or ionic species. This process is especially useful for oxidation-reduction processes, wherein said species is an ion having the same charge as the porous electrode. The porous electrode is isolated from the oppositely charged electrode by a semipermeable membrane, said membrane being impermeable to said dissolved species. In a much preferred embodiment, the dissolved species is chromiun in the +3 oxidation state, e.g., the chromium available in chromic acid solutions which have been "used" in plastic etching processes or in processes for the oxidation of organic compounds; and the membrane is fluoro sulfonic acid membrane. In this embodiment the "used" chromic acid solutions may be substantially regenerated and cycled for reuse in the above-mentioned processes. The porous anode preferably used in the regeneration of chromic acid solutions comprises a lead alloy or compound.

BACKGROUND OF THE PRIOR ART

It is recognized in the art that in electrochemical processes, it may be undesirable for certain dissolved metal ions to contact one of the electrodes. For example, as discussed further in U.S. Pat.No. 3,634,213, various dissolved metal salts may undergo an undesirable oxidation-reduction reaction whereby the metal forms an insoluble compound, or destroys the electrodes. This problem is solved in the process taught in said patent, by utilizing a cationic permiselective membrane to separate the anode and cathode compartments, whereby the dissolved metal salt is isolated from the electrode at which the undesirable oxidation-reduction reaction would occur. The electrodes utilized in the patent have configurations well known in the art, and further the patent does not discuss nor provide a solution for the problems which occur when the dissolved metal salt or other charged species, capable of undergoing an oxidation-reduction reaction, is to be oxidized or reduced at an electrode having the same charge.

In an electrochemical process for regenerating chromium plating bathes, wherein dissolved chromium in the +3 oxidation state is oxidized to the +6 oxidation state by contact with an anode, it is desirable, for maximum efficiency, to prevent contact of the dissolved chromium with the cathode.

U.S. Pat. No. 3,616,364 teaches the use of an electrolyzing anode and an electrolyzing cathode, said cathode being in intimate contact with a material in a low hydrogen overvoltage state, and said electrolyzing anode having a surface area at least equal to the surface area of said electrolyzing cathode, to continuously oxidize trivalent chromium to hexavalent chromium. Said electrolyzing anode and cathode, may be separated from the plating anode and cathode by a porous partition.

The problem, although not specifically discussed, of contacting the positively charged chromium, i.e., ($r^{+3}$) with the positive electrode, i.e., the anode, to oxidize the chromium to the +6 oxidation state is solved by utilizing an anode having a large surface area. It would be desirable to have an anode having a large surface area while minimizing its physical dimensions.

The process taught in this patent, does not utilize a compartmentalized anode and cathode compartment, as does the process of the instant invention. As further discussed, hereinbelow, in a chromic acid regeneration process it is desirable to isolate the cathode from the dissolved chromium, by use of a semipermeable membrane. The patent teaches the use of a porous partition, to form separate compartments, however, said partition is permeable to all dissolved species, and furthermore, both the anode and the cathode are located in the same compartment.

U.S. Pat. No. 3,481,851 teaches a process for reoxidizing used chromic acid metal treating solutions by oxidizing said solution into the anode compartment of an electrodialysis cell, comprising an anode and cathode separated by a cation permeable membrane. The membrane is described as a commercially available material having a high percentage of cationic ion-exchange material. However it is well known that many membrane materials do not hold up under contact with chromic acid solutions or other oxidizing environments. Furthermore there is no teaching relating to obtaining optimum contact of the dissolved chromium with the anode, instead it was recognized by the patentee that the trivalent chromium was more often in contact with the membrane and thus a significant amount moved across the membrane into the cathode chamber.

U.S. Pat. No. 3,511,765, teaches a process for oxidizing or reducing organic compounds in an electrochemical cell, wherein both electrodes are provided in a liquid permeable form. There is no teaching that the electrodes may be isolated from each other by a semipermeable membrane, thus as pointed out by patentees, the process of the patent is limited to reactions where the oxidation product does not react at the cathode, or the reduction product at the anode.

SUMMARY OF THE INVENTION

It has now been unexpectedly discovered, in a process for changing the oxidation state of a compound or ionic species, by contacting with an electrode, that improved efficiency is obtained by providing said electrode in a porous configuration, and passing said dissolved species through said porous electrode. This process conveniently is carried out in an electrochemical cell, which comprises an anode and cathode, either of which may be the porous electrode. The process of the instant invention is especially preferred for changing the oxidation state of dissolved ionic species, especially when the desired oxidation state change, must be effected at the electrode having the same charge as the ionic species. Preferred ionic species are transition metals, selected from Group VI, VII and VIII of the Periodic Table of the Elements, and generally dissolved in aqueous solution. The compound or ionic species is prevented from contacting the oppositely charged electrode, by use of a semipermeable membrane, which is substantially impermeable to said compound or ionic species, to divide the electrochemical cell into separate anode and cathode compartments.

The compound or ionic species may be continuously passed through said porous electrode into the electrode compartment and removed, by means known in the art of fluid mechanics. For example the compound or ionic species may be passed through said porous electrode by pumping or gravity flow. The compound or dissolved species is preferably passed through said porous electrode as it enters the electrodes potential field, thus assuring intimate contact with said electrode. After contact with said porous electrode, the compound or dissolved species, at least a portion of which will be in a changed oxidation state, may be removed from the electrode compartment or recirculated through the porous electrode.

It should be noted that the term "compound", as used throughout the specification includes compounds that are neat or dispersed in an inert liquid. Dissolved species include both neutral and ionically charged species. The only requirement for the compound or dissolved species utilized in the process of the instant invention is that it be provided in a fluid form, so that it can be passed through the porous electrode.

The porous electrode which is utilized in the process of the instant invention may be selected from materials known in the art, for example lead electrodes, wherein the lead may be present as an alloy or an oxide; noble metal electrodes, e.g., platinum, iridium, palladium, rhodium, etc., and the alloys thereof, e.g., platinum-iridium, platinum-rhodium, etc.; electrodes of nickel, iron, cobalt, chromium, tantalum, molybdenum, etc., including the alloys, oxides, and sulfides thereof; carbon electrodes; and combinations thereof. The above electrodes may be utilized in either a supported or nonsupported form. The porous electrode must be provided in a configuration which will allow a fluid comprising said compound or dissolved species to be passed through it. For example, the electrode may be perforated with holes, e.g., holes having diameters ranging from 0.02 inches to 1 inches, may be conveniently used. Other forms of the above electrode materials may also be conveniently used, e.g., expanded metal; metal cloth, screen or net, e.g., mat, woven wire mesh, double crimp, dutch weave, twilled dutch weave, twilled, stranded, or sieve cloth, and metallic filter cloth, available in 2 × 2 up to 400 × 400 mesh; sintered metal, e.g., having pore sizes ranging from 0.1 to 200 microns; etc. In the preferred electrochemical cell used in the instant process, as further described below, the porous electrode is provided in a cylindrical shape, thus electrode materials which can be fabricated in this configuration are preferred.

The semipermeable membrane utilized to divide the anode from the cathode is selected to be substantially nonpermeable to the compound or dissolved species and the reaction products thereof, but must be permeable to the species carrying the electrical charges between the cathode and anode, i.e., electrically conductive.

Membrane materials which are known in the art may be used in the instant process. For example, membranes prepared from cellulose esters such as cellulose mono-, di-, and triacetates, cellulose proprionate, cellulose butyrate, cellulose acetate proprionate, cellulose acetate butyrate; cellulose ethers such as ethyl cellulose; superpolyamide (or more simply, polyamide) polymers which have become generically characterized as "nylons" such as Nylon 6, Nylon 6—6, Nylon 6–10, Nylon 11, etc.; polycarbonates; polyvinyl chloride and vinyl chloride polymers; vinylidene chloride polymers; acrylic ester polymers; organic silicone polymers; polyurethanes; polyvinyl formals and butyrals and mixtures thereof; methacrylate polymers; styrene polymers; polyolefins such as polyethylene, polypropylene and the like (including such species as chlorinated and sulfonated polyethylene, polypropylene, etc.); polyesters such as polyethylene glycol terephthalate; acrylonitrile polymers; etc., may be used. The most preferred membrane material, as discussed further herein below, is perfluorosulfonic acid polymer.

This preferred membrane comprises a perfluorocarbon polymer having pendant sulfonic acid or sulfonate groups or sulfonic acid and sulfonate groups. Said perfluorocarbon polymer has the pendant groups attached either directly to the main polymer chain or to perfluorocarbon side chains attached to the main polymer chain. Either or both the main polymer chains and any side chain may contain oxygen atom linkages (i.e., ether linkages). The perfluorocarbon polymer from which the membrane of the invention is prepared includes perfluorocarbon copolymers with said pendant groups as well as perfluorochlorocarbon polymers having mixed chlorine and fluorine substituents where the number of chlorine atoms is not more than about 20% of the total chlorine and fluorine atoms, with said pendant groups. The preferred membrane may optionally be reinforced, for example, by using a screen of a suitable material or a cloth of polytetrafluoroethylene or other reinforcing material. The perfluorocarbon polymers used for preparing the membrane may be prepared as disclosed in U.S. Pat. Nos. 3,624,053; 3,282,875; and 3,041,317. The equivalent weight of the preferred copolymers range from 900 to 1400 where equivalent weight is defined as the average molecular weight per sulfonyl group. The preferred reinforcement is cloth of polytetrafluoroethylene. The preferred perfluorocarbon copolymers are prepared by copolymerizing a perfluorovinyl ether having a sulfonyl fluoride group and tetrafluoroethylene followed by converting the sulfonyl fluoride group to either a sulfonic acid group or sulfonate group or both. In the preferred electrochemical cell used in the instant process, the membrane is provided in a cylindrical configuration, which is concentrically disposed in relation to the porous electrode. Thus membrane materials which may be fabricated in a cylindrical configuration are preferred.

In general, the membrane is selected to be substantially inert, when contacted with the compound or dissolved species, and/or other species present in the electro chemical cell. For example, if sulfuric acid is present in the anolyte or catholyte solution, the membrane should be substantially inert to sulfuric acid at the conditions at which the cell will be operated.

The membrane, is generally provided in a minimum thickness, so as to maximize transfer of the ions carrying the charges generated during the operation of the electrochemical cell, across said membrane. The membrane will generally have a thickness of from 0.001 to 0.080 inches, preferably of from 0.003 to 0.015 inches.

The various oxidation and reduction reactions which may be carried out by the process of the instant invention include the hydrodimerization of acrylonitrile into adiponitrile.

In a specially preferred embodiment of the process of the instant invention, chromic acid solutions, which are in a reduced or partially reduced state, are conveniently oxidized for reuse.

Chromic acid solutions are utilized in plastic etching operations, e.g., preparation of polypropylene, polyethylene, ABS, plastic for plating; organic oxidation processes, e.g., the oxidation of cyclohexanone to adipic acid, p-xylene to terphthallic acid etc.; anodizing of aluminum; etching of printed circuits; and pickling of brass and copper.

During use, these solutions, wherein the chromium is present in the +6 oxidation state, are continuously reduced, i.e., the chromium is converted to the +3 oxidation state, until they reach a point at which they are no longer effective, and must be regenerated. As stated above the prior art processes for regeneration are not commercially attractive. The process of the instant invention, however, is especially suited to the regeneration of these "used" chromic acid solutions.

Used chromic acid solutions generally comprise from about 3 to about 300 oz. per gallon $Cr^{+3}$ in a aqueous solution. This solution may be reoxidized at the anode of an electrochemical cell. According to the process of the instant invention, the anode may be fabricated from a lead alloy, and provided in a porous form. The anode is isolated from the cathode by use of a perfluorosulfonic acid membrane, which is substantially impermeable to the dissolved chromium species and which forms separate anode and cathode compartments. In this embodiment the used chromic acid solution will function as the anolyte. The cathode may be stainless steel and the catholyte a nonpolarizable solution, e.g., aqueous $H_2SO_4$. The anode is maintained at a voltage of at least 1.6 volts, preferably from 1.8 to 12 volts. At these voltages a lead peroxide film is believed to be formed on said anode, and at said lead peroxide surface $Cr^{+3}$ is converted to $Cr^{+6}$. As the voltage increases the reaction favors the $Cr^{+3} - 3e^- \rightarrow Cr^{+6}$ conversion over $20^{=} - 4e^- \rightarrow O_2$. However, as the current is increased two competing mechanisms favor the formation of oxygen. At high anode current densities polarization occurs from solution depletion at the surface of the electrode and as oxygen evolution increases from polarization, less space is available on the anode due to the presence of gas bubbles. The instant invention solves these problems by providing intimate contact between the anolyte solution and the anode by flowing the solution through the anode with a high degree of agitation. Further agitation may be provided by placing flexrings or other packing material, around the anode. Thus, in the process of the instant invention, high efficiencies at high current densities and high voltages are achieved.

The oxidized chromic acid solution may be removed from the anode compartment and reused or recycled through said porous anode.

Preferably the electrochemical cell will be operated at a temperature of from 60° to 220° F. Based on the dimensions of said electrochemical cell, i.e., anode compartment volume, anode surface area, anode pore size and distribution, etc., and with consideration of the voltage requirements described above, the skilled artisan may design an electrochemical cell for use in the process of the instant invention.

The electrochemical cell of the instant invention comprises two electrodes at least one of which is porous, a semipermeable membrane positioned between said electrodes, thereby defining separate electrode compartments, means for maintaining a voltage at said electrodes, and means for passing an electrolyte through said porous electrode. The electrochemical cell defined above, may further comprise means for removing said electrolyte from said cell, after said electrolyte passes through said porous electrode. The means for passing said electrolyte through said porous electrode, and the means for removing said electrolyte after said electrolyte passes through said porous electrode, may comprise a pump, valves, a holding tank for said electrolyte, and fluid connections between said holding tank and said electrochemical cell.

Similarly, the nonporous electrode compartment may comprise means for passing an electrolyte into said compartment and means for removal of said electrolyte therefrom.

The preferred electrochemical cell, as described in FIG. 1, comprises a tubular cathode 10, a cylindrical semipermeable membrane 11, positioned in a coaxial relationship about said tubular cathode, a cylindrical porous anode 12, positioned in a coaxial relationship about said membrane, and a cylindrical housing 13, positioned in a coaxial relationship about said anode. The wall of the housing, the anode and the membrane thus define separate compartments of the electrochemical cell.

The wall of the housing, which is preferably titanium, or less preferably a nonconducting material, is provided with fluid inlet means, whereby an anolyte may be passed into the first compartment of the electrochemical cell, said first compartment being defined by the housing wall and the anode. The wall of the housing is also provided with fluid exit means which are connected directly with the anode compartment of the electrochemical cell, said anode compartment being defined by the anode and the membrane. In the preferred embodiment of FIG. 1 said fluid inlet means 14 and exit means 15 are preferably titanium pipes having an IPS of from ½ inch to 1½ inches.

Note that the titanium pipe utilized to remove the anolyte from the anode compartment is positioned adjacent to a port provided in said anode. This port is of sufficiently greater dimension than the pores in the anode, thus a major portion of the anolyte solution leaves the anode compartment through this port. Note also that the exit pipe is positioned so as to not obstruct the removal of the anode from the cell. The aforedescribed pipes may be attached to housing by welding.

The cathode compartment, as defined by the cylindrical membrane, is provided with fluid inlet and exit means, whereby a catholyte solution may be passed into and removed from said cathode compartment. The tubular cathode itself, which preferably extends, essentially along the entire axis of the cylindrical membrane, provides said fluid inlet means, that is ports of various dimensions and location are provided in said tubular cathode, for passing the catholyte into the cathode compartment. Said fluid inlet means 10 and exits means 16 are preferably stainless steel pipes having an IPS of from ¼ inch to 1½ inch.

The electrochemical cell further comprises a top 17, and a base 18, either of which may be detachably secured to the cylindrical housing. As described in FIG. 1, and as preferred, the base and said cylindrical housing will form one integral piece, e.g., the base may be welded to said cylindrical housing. The base may be provided with a circular groove whereby said cylindrical anode is seated, and a centrally positioned notch whereby a teflon plug, as discussed further below may be seated. The top may be attached to said housing by flange bolting, or alternatively, although less preferred, said housing and said top may be joined with a threaded connection. The base material is preferably titanium or less preferably a nonconducting material.

The anode and the membrane have been, in general, described above. In the preferred embodiment of FIG. 1, the membrane comprises a perfluorosulfonic acid polymer which may be laminated with teflon cloth. The membrane may be supported by a tubular screen, 19 which is fabricated from polypropylene teflon, or other inert material, said screen providing dimensional stability for said membrane. The screen may be oriented to contact either the anolyte, the catholyte, or both. In FIG. 1, the cylindrical membrane is sealed at both ends with circular teflon plugs. The bottom plug 20 acts to seal said cylindrical membrane thus isolating the cathode compartment from the anode compartment, and further provides for convenient seating in the aforedescribed notch provided in the base. The upper plug is provided with pipe threads for connection with the top. The upper plug is further provided with circular threaded channels, by means of which said tubular cathode and said fluid exit pipe are secured to said upper plug. The tubular cathode, as shown in FIG. 1, is inserted through said upper plug and secured by means of a teflon ring 22 which is provided with threads for connection with the upper plug. A pressure fitting 23, which when tightened forces the plastic ring against the tubular cathode, may be utilized to seal the cathode compartment.

The anode material and structure have been described above. In the preferred embodiment, as described in FIG. 1, the anode is a lead alloy perforated with ¼ inch holes on ½ inch centers. The anode is bonded to a lead 0 ring 24, e.g., by soldering, which is in turn bonded, e.g., soldered to a titanium 0 ring 25. The titanium 0 ring may be platinized at the surface which is in contact with the lead 0 ring, so as to facilitate soldering of the lead to the titanium. Threaded holes are provided in the titanium 0 ring whereby said anode is attached to said top by means of bolts 26. The bolts will be of a conducting metal which may provide for connection of the anode with the means for energizing the electrochemical cell. Alternatively the titanium 0 ring and the top may be an integral piece, however, ease of fabrication makes the arrangement of FIG. 1 preferable. A copper [ring] 27, or other conducting metal is provided, which may be utilized to provide the connection for the anode and the means for energizing the electrochemical cell. Said copper ring may be attached to said top by means of bolts 26, or soldered or welded.

The electrochemical cell of the instant invention, will, of course, during use, additionally contain a catholyte and an anolyte, as described above.

Connection of the anode and cathode with an energizing source, and the various energizing sources, which may be used in the instant invention are well known in the prior art and need not be discussed further herein.

The skilled artisan may make many variations of the above cell described herein, without departing from the spirit of the invention. For example, the fluid inlet and exit means for said first compartment and said anode compartment, may be reversed, or attached to the top or the base of the instant electrochemical cell. The coaxial arrangement of the cylindrical housing, the porous anode, the membrane, and the tubular cathode, may be distorted, and the dimensions of the anode and/or the cylindrical housing may be varied slightly to allow a small portion of the anolyte to flow under or over the porous anode.

The following are specific embodiments of the instant invention.

EXAMPLE I

An electrochemical cell was devised with an anode made of Nalco metal lead alloy that had perforations ¼ inch in diameter on ½ inch centers. The anode diameter was 5 inches and was 12 inches tall for a total interior anode surface of 219.8 sq. in. A 304 stainless steel tube, ½ inch in diameter was used as a cathode. A perfluorosulfonic acid membrane in a cylindrical form 2¾ inch in diameter was used to separate the anode and cathode compartments. The entire unit was enclosed in a chlorinated polyvinylchloride housing. The catholyte was 1 normal sulfuric acid and the anolyte was a plastic etching solution. The plastic etching solution contained 75 g/l of trivalent chromium measured as chromic acid and 65 g/l of chromic acid in a 12 N sulfuric acid solution. Each solution was pumped at the rate of 3 gallons/minute with an anolyte solution reservoir volume of 5 gallons and a catholyte solution reservoir volume of 5 gallons. Both solutions were held at 48°–55° C. The solutions were circulated for 1½ hours at a total D.C. voltage of 25 volts. After a 1½ hour period the solution was analyzed and found not to have changed from the original analysis. During this period it is believed that a lead peroxide surface was formed on the anode. The current was increased to 80 amperes and 5V and over the next 5 hours a rate of conversion of 2 g/l hr. was observed for an electrical efficiency of 48%.

EXAMPLE II

An electrochemical cell as described in Example I was fabricated except that the anode was 9 inches in diameter and 5¼ inches high for a total interior anode of 148 inches. The anolyte after 1½ hours of running was analyzed as 55 oz/gal. chromic acid, 11 oz/gal trivalent chromium measured as chromic acid in a 12N sulfuric acid solution. All other parameters were the same as in Example I. Over a 3 hour period with a total current of 30 amps a rate of 4 g/l-hr. was observed for an electrical efficiency of 96%.

What is claimed is:

1. In an electrochemical process for oxidizing chromium in the +3 oxidation state to the +6 oxidation state comprising the steps of: providing an electrochemical cell having an anode compartment containing an anode, a cathode compartment containing a cathode and a semipermeable membrane capable of preventing passage of chromium in the +3 oxidation state separating said anode compartment from said cathode compartment; providing an acidic catholyte solution in said cathode compartment, said catholyte solution being substantially free of chromium in the +3 oxidation state; providing an anolyte solution in the anode compartment, said anolyte solution containing chromium in the +3 oxidation state; and passing a current between said anode and said cathode; the improvement wherein said anolyte solution is passed through and fills a multiplicity of pores provided in said anode while current is passed between said anode and cathode.

2. The process of claim 1, wherein said semipermeable membrane is a fluorosulfonic acid membrane.

3. The process of claim 1, wherein said porous anode is a lead compound or alloy.

4. The process of claim 3, wherein said porous anode is maintained at a voltage of at least 1.6 volts.

5. The process of claim 4, wherein said anolyte solution comprises from about 3 to about 300 ounces per gallon $Cr^{+3}$.

* * * * *